US010876746B2

(12) United States Patent
Handsaker et al.

(10) Patent No.: US 10,876,746 B2
(45) Date of Patent: Dec. 29, 2020

(54) AIR DISTRIBUTION HUB

(71) Applicant: Innovative Lighting, LLC, Roland, IA (US)

(72) Inventors: Jerrold Handsaker, Roland, IA (US); Harry Aller, Indianola, IA (US); A. Brent York, Fort Langley (CA)

(73) Assignee: Innovative Lighting, LLC, Roland, IA (US)

( * ) Notice: Subject to any disclaimer, the term of this patent is extended or adjusted under 35 U.S.C. 154(b) by 0 days.

(21) Appl. No.: 15/730,049

(22) Filed: Oct. 11, 2017

(65) Prior Publication Data

US 2018/0283705 A1 Oct. 4, 2018

Related U.S. Application Data

(60) Provisional application No. 62/406,529, filed on Oct. 11, 2016.

(51) Int. Cl.

| | |
|---|---|
| ***F24F 3/056*** | (2006.01) |
| ***F24F 11/30*** | (2018.01) |
| ***F24F 13/08*** | (2006.01) |
| ***F24F 11/00*** | (2018.01) |
| ***F24F 13/02*** | (2006.01) |

(52) U.S. Cl.

CPC ..... *F24F 3/056* (2013.01); *F24F 11/0001* (2013.01); *F24F 11/30* (2018.01); *F24F 13/0236* (2013.01); *F24F 13/08* (2013.01); *F24F 2011/0002* (2013.01); *F24F 2221/02* (2013.01)

(58) Field of Classification Search

CPC ..... F24F 3/056; F24F 11/30; F24F 11/0001; F24F 13/0236; F24F 13/08; F24F 13/078; F24F 2003/003; F24F 13/0446; F24F 2011/0002; F24F 2221/02

See application file for complete search history.

(56) References Cited

U.S. PATENT DOCUMENTS

| | | | | |
|---|---|---|---|---|
| 3,635,245 | A * | 1/1972 | Canfield | F24F 3/00 137/601.05 |
| 5,279,609 | A * | 1/1994 | Meckler | F24F 3/00 236/49.3 |
| 5,461,877 | A * | 10/1995 | Shaw | F24F 5/0003 62/176.6 |
| 2006/0234621 | A1* | 10/2006 | Desrochers | F24F 3/044 454/239 |
| 2008/0003940 | A1* | 1/2008 | Haglid | F24F 3/14 454/228 |
| 2009/0236432 | A1* | 9/2009 | Malloy | F24F 3/044 236/49.3 |

(Continued)

FOREIGN PATENT DOCUMENTS

| | | | | |
|---|---|---|---|---|
| EP | 3168543 | A1 * | 5/2017 | F24F 7/06 |

*Primary Examiner* — Devon Russell

(74) *Attorney, Agent, or Firm* — Westman, Champlin & Koehler, P.A.

(57) ABSTRACT

A system for control of conditioned air within a space includes a distribution hub connected to provide conditioned air, fresh air, or a combination thereof to the space, and to exhaust and/or return air from the space through the distribution hub, and a controller coupled to the distribution hub to control the provision of the conditioned air and the fresh air, and to control removal of the return air.

17 Claims, 2 Drawing Sheets

(56) References Cited

U.S. PATENT DOCUMENTS

| | | | | |
|---|---|---|---|---|
| 2011/0237175 | A1* | 9/2011 | Buseyne | F24F 13/0236 454/254 |
| 2012/0235579 | A1* | 9/2012 | Chemel | F21S 2/005 315/152 |
| 2013/0320573 | A1* | 12/2013 | Fisher | F24F 6/02 261/128 |
| 2016/0110567 | A1* | 4/2016 | Rooyakkers | G06F 21/86 726/34 |
| 2017/0067659 | A1* | 3/2017 | Silver | F24F 7/08 |
| 2017/0307242 | A1* | 10/2017 | Handsaker | F24F 11/30 |
| 2017/0315697 | A1* | 11/2017 | Jacobson | G06F 16/26 |

* cited by examiner

AIR DISTRIBUTION HUB

RELATED APPLICATIONS

The present application is based on and claims the benefit of U.S. provisional patent application Ser. No. 62/406,529, filed Oct. 11, 2016. A related disclosure entitled POE CONTROLLED LIGHT FIXTURES WITH INCORPORATED POE CONTROLLED VARIABLE CONDITIONED AIR VENTS discloses further integration of this disclosure into building HVAC systems with passive and active delivery mechanisms for airflow and other non-lighting functions.

BACKGROUND

Conventional lighting fixtures for the last century have largely been manufactured in factories employing raw materials such as steel, aluminum, glass and plastic with lighting components such as light bulbs, sockets, ballasts and wire. The processes used have resulted in the term "metal benders" as a colloquial expression to describe the traditional lighting companies that employ standard industrial processes to construct lighting fixtures by wrapping metal around conventional light bulbs. The constituent parts of conventional lighting fixtures are primarily made from sheet metal, extrusions and other raw materials such as plastics that are heavily processed in factories with die cutting, punching, forming, welding, painting and other industrial processes. During the last decade, with the rapid decline in price and rapid increase in performance, the Light Emitting Diode or 'LED' has reached the point where its performance exceeds all conventional light sources and its cost now rivals conventional light sources, especially where the total cost of ownership over the life of the lighting installation is considered. The properties of LEDs, combined with the miniaturization of the scale for electronics of all types has created a unique circumstance for the invention of new devices in the ceiling area of buildings that can provide for illumination and other useful functions. Furthermore, the miniaturized scale of LEDS also creates opportunities for miniaturization of lighting functions which can be combined with other systems to drive improved economics and reduced environmental impact.

Similarly, conventional HVAC systems comprise heaters, chillers, fans, ducts, dampers and vents that provide for the controlled flow of "conditioned" air within the space. The installation of these systems is usually done at the building inception, or major renovation, and these systems often remain in place through retrofit cycles of surfaces, furniture, wall treatments and floor coverings. These HVAC systems are conventionally separated from the lighting functions and are usually installed and managed by a different group of contractors and specialists that fine tune the building's HVAC automation systems to control the comfort level of spaces. Rarely do these HVAC and lighting systems cooperate, except in the relatively well known case of, so called "air handling" luminaires, which are primarily about the provision of an "exhaust path" through the luminaire into the ceiling plenum (the area above the ceiling tiles) where air can eventually be recycled, or vented, from the space through a hidden HVAC inlet duct. These passive systems fail to provide much more functionality than a convenient exhaust ventilation path within the space and are far from automated.

Conventional HVAC systems use several levels of installation for various components. For example, HVAC systems that operate with multiple zones, such as within a residential or commercial building, use zone controllers that are positioned and installed in ducts and plenums. These zone controllers typically require electrical connection to high voltage, and therefore require a licensed electrician for installation, including the routing and proper mounting of high voltage electrical wire. Such installations typically require multiple visits from an electrician, for initial wiring, and for final connection and testing. An electrician installs zone controllers and/or zone boxes initially into the duct or plenum, and returns after completion of the installation of the HVAC system for final connection. Scheduling issues often result in longer installation times, and more costly installations, as multiple sub-contractors are used during the installation.

DETAILED DESCRIPTION

Figure 1:
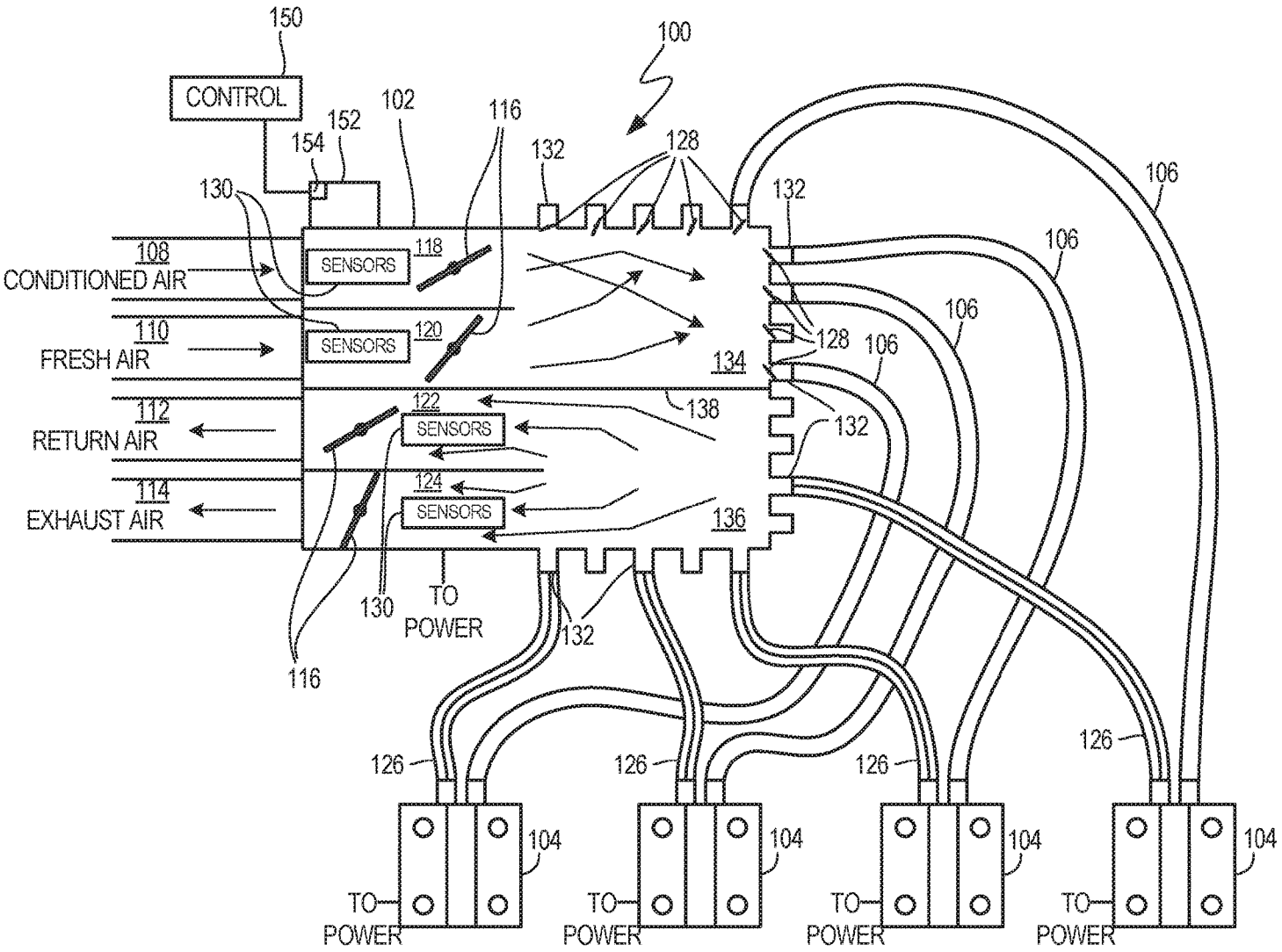
FIG. 1 is a block diagram of a distribution system according to an embodiment of the present disclosure.

There is a a need in the art for improvements in HVAC zone control, and for HVAC functions that can be used without requiring high voltage, that can provide multiple functions such as lighting and HVAC that can optionally be combined with sensing and response feedback to integrated control systems.

There is also a need in the art for consideration of how miniaturization of lighting functions can be combined with suitable hardware structures into so-called "service nodes" that can exist, for example, in a ceiling plane, and that can provide multiple functions such as lighting and HVAC that can also optionally be combined with sensing and response feedback to integrated control systems.

The traditional commercial office ceiling contains many systems including several lighting fixtures, a series of heating/cooling/return air vents, often with high voltage (110-120 Volts AC) zone control systems, plumbing, sprinkler supply, electrical supply including for zone control systems, and cabling for data networks. However, in the exposed ceiling surface it is primarily the light fixtures and air ventilation penetrations that are visible to the space below. The balance of the ceiling is vacant. The lighting fixtures are usually confined to particular locations as they are needed to be distributed to balance lighting levels and are powered by high voltage AC power which is protected by steel conduit which is terminated by attaching it to the electronic light fixture. The lighting fixtures are usually installed and maintained by a licensed electrician and are considered as part of the overall electrical system operating within the building and office. Typical data networks for the provision of data to desktop computers and phones are also installed within the ceiling plenum and are often delivered by multi-conductor low voltage cable systems such as Cat 5 cable. These cable runs often come from a "server room" and are strung through the ceiling plenum with "drops" within walls and intermediate locations throughout the office to receptacles where PCs and phones can be plugged in. These are usually low voltage or power limited systems which are usually installed and maintained by network IT installation specialists. One of the primary advantages for these low voltage networks is that the provisions for electrical safety that apply to conventional AC service voltages (e.g., 120 Volts, 240 Volts, etc.) do not apply, which allows the wiring to be run through spaces above and around the office without the difficulty of installing it within rigid or metallic conduit, or for terminating within electrical junction boxes. Such cables may be used to provide power to low voltage devices through what is referred to as power over Ethernet (POE).

The HVAC air vents in the ceiling are usually supplied with air through flexible or fixed ducting running from the heating or cooling equipment (hereinafter "HVAC equipment") to, most commonly, louvered openings that can be manually adjusted to deflect air flow away from directly hitting occupants in the space. The heated or cooled air from the equipment (hereinafter referred to as "conditioned air") flows from the HVAC equipment to the office by passing thru the ducting to the vents which allows the conditioned air to enter the room. Usually the vents are installed by the HVAC personnel and are very seldom repositioned in the building during its lifetime. The heating and cooling of the building is typically designed, operated, and maintained by HVAC personnel and building engineers, separate from the electrical system and data networking systems.

Notably, these systems are all independent and forced coordination of the HVAC and lighting systems, for example, is historically not combined as they are usually installed and maintained separately with their individual control systems.

This disclosure provides a way to integrate HVAC zone controls with low voltage power solutions to provide a power and control system within the occupied space thru one networked system which automates the process and provides better individual comfort to the users while reducing the overall energy required. Prior art zone controls require high voltage wiring, and must be installed by licensed electricians.

This disclosure includes embodiments which provide for active control of conditioned air within an office space by virtue of valves, vanes, dampers or other mechanisms which can control one or more of the direction or the mass flow rate for conditioned air within the office space at different locations within the air duct system. Embodiments of the disclosure include active zone control and distribution built in, for example, to the ducts or plenums of a residential or commercial building. In some embodiments, distribution of conditioned air may be made through lighting fixtures, as discussed further in the related co-owned application described above.

Embodiments of the disclosure may include active control built in, for example, the luminaire housing, attached to the luminaire housing, included in an intermediate position along a duct that is feeding the luminaire housing, or at a distribution box where individually controlled ducts feed a plurality of light fixtures with differential air flows based upon a desired state for conditioned air below the ceiling plane.

A distribution hub 100 for an HVAC and/or lighting solution that uses low voltage is shown in block diagram form in FIG. 1. Distribution hub 100 comprises on one embodiment distribution box 102 containing connections to secondary distribution fixtures 104 via distribution hoses or conduit 106. Conditioned air, for example, 108, comes from a heater or chiller source and is ducted through a pipe or duct to the distribution box 102 of hub 100 for the room or area being serviced. In addition to conditioned air 108, the distribution box 102 of hub 100 may be selectively supplied with fresh air 110. Distribution box 102 may also be used to move return air 112 and exhaust air 114, or combinations thereof that could be flowing within channels such as channels 118, 120, 122, and 124. Return air 112 and/or exhaust air 114 is directed from secondary distribution fixtures 104 via connections to the distribution box 102 via hoses or conduit 126.

Embodiments of the area distribution hub 100 save energy, increase occupant comfort, and reduce installation costs in various ways. The embodiments provide for standardized installation and operation experience into one building automation realm, i.e., low voltage solutions, instead of the three or four presently existing disciplines.

A distribution hub 100 is in one embodiment an intermediary device between a conditioned air generation system and a conditioned air delivery system, which may in some embodiments be further combined with a light delivery system such as luminaires with air venting as described in co-owned applications. Embodiments of the distribution hub 100 help endpoints of a building automation system deliver light, safety and comfort to an occupant.

In one embodiment, the distribution hub 100 is mounted or otherwise positioned within a ceiling or plenum area above the area to which it will deliver air and provide circulation. The hub 100 receives power and control signals over standard or enhanced Ethernet cables. The hub 100 includes in one embodiment a plurality of powered valves 116 and 128 to assist in the distribution of air (such as conditioned air 108 and/or fresh air 110), and to allow the flow of return air 112 and/or exhaust air 114 in a user controlled manner to and from the occupied space. In some embodiments, the hub 100 restricts the introduction of expensive conditioned air to an unoccupied space.

Hub 100 in one embodiment further comprises sensors 130 positioned to sense parameters of conditioned air 108, fresh air 110, return air 112, and/or exhaust air 114. The hub, based on desired conditions within the area to be conditioned, may pull fresh outside air 110 into the system if the readings of various sensors 130 indicate that the temperature and condition of the fresh air 110 is appropriate. Determination of the parameters and control of the distribution hub 100 is in one embodiment controlled by a controller 150, which may be located remotely from the distribution hub 100, or in alternative embodiments, within the distribution hub 100. Connection to the controller 150 may be via wired or wireless connections, such as are known in the art.

The variable controlled valves 116 may be maneuvered to move air in specific ways in the channels 118, 120, 122, and 124. The variable controlled valves 128 may be maneuvered to allow air movement air out of the distribution box, such as through openings 132 to a space, or to and from the secondary distribution fixtures 104 via hoses or conduits 106 and/or 126. The positioning of the valves 116 and 128 can deliver more or less conditioned air to a specific area of the room, such as where the room occupant is, and less conditioned air to vacant areas of the space.

In another embodiment, valves such as valves 116 and 128 are incorporated into the secondary fixtures 104, which may include lighting solutions such as those shown and discussed in a co-owned application entitled POE CONTROLLED LIGHT FIXTURES WITH INCORPORATED POE CONTROLLED VARIABLE CONDITIONED AIR VENTS. In such an implementation, the secondary fixtures with lighting will provide more vents than traditionally are present within a space. Further, the vents will be located in many locations while still restricting the number of penetrations in the ceiling due to the use of multi-function devices and not solo single function devices.

The controller 150 includes in one embodiment computer implemented instructions in the form of computer readable code to cause a processor or computer having a processor to cause the operation of the valves, to monitor the sensors, and to control operation depending upon parameters measured and calculated by the processor given the readings of the sensors. Such sensors may further include, by way of example only and not by way of limitation, sensors within the secondary fixtures 104 that perform similar measurements and provide information to the controller 150. The computer implemented instructions in one embodiment provide control of lighting and air flow to the space with accuracy exceeding that of present systems. The system 100 may also, in another embodiment, have sensors that automatically change the configuration of the lighting and air conditioning setup for a space should the occupant change location within the room. Such sensors could therefore include motion sensors, temperature sensors, and the like. In some embodiments light and air flow will increase automatically in the new location area of the occupant and decrease appropriately in the vacated area.

The return air function, that is returning air through the distribution box 102 directly or via the secondary fixtures 104, is used in one embodiment to prevent the distribution of smoke or other contaminants emanating from the space controlled by the system 100. The system 100 is capable of isolating ventilation within the area when sensors locate a contaminant, such as smoke, until the danger is passed. The controller or the sensors may activate an appropriate alarm, or notify appropriate authorities, or both, if a contaminant such as smoke is detected.

A sensor 130 in the fresh air channel 120, or configured to monitor the inflow of fresh air 110, may trigger turning off or otherwise regulating the flow of conditioned air 108 through the use of the valves such as valve 116 if a window for the provision of fresh air is opened. Further, additional sensors may be disposed within the area, such as but not limited to sensors at windows or other air inflow locations to the area. The controller may therefore turn off conditioned air to a space if a window is opened or if the occupant requires the fresh air system to be activated. Valves 116 and 128 may in one embodiment comprise directional air louvers that are rotatable or otherwise adjustable to direct air flow in a particular direction. Still further, valves and directional air louvers may be separated into individual components, and located at different positions within or in proximity to the distribution box 102 and/or secondary fixtures 104, without departing from the scope of the disclosure.

In another embodiment, a fan (not shown) internal to the distribution box 102 may be activated to increase air flow within the space without the aid of a furnace fan. The increased air flow together with the directional air louvers and/or valves can reduce or eliminate the use of ceiling or floor fans within the space.

In one embodiment, the inflow channels 118 and 120 of the distribution box 102 are in a first portion 134 of the distribution box 102, and the outflow channels 122 and 124 of the distribution box 102 are in a second portion 136 of the distribution box. In one embodiment, the first portion and the second portion are isolated from one another by wall or division 138. In another embodiment, wall 138 may be provided with a peltier system to supplement local efficiency of the system 100.

The exhaust air path through distribution box 102 channel 124 and exhaust air pipe or duct 114, either from directly outside distribution box 102, or via hoses or conduits 126 from secondary fixtures 104, can assist in speeding up expulsion of smoke or other contaminants from the area/building once the source of the smoke or contaminant has been eliminated, or even while it has not yet been eliminated. Likewise, the exhaust air channel 124 allows balancing of the area's air pressure when outside fresh air 110 is introduced into the building. Further, the exhaust air vent may be activated for the purpose of eliminating smells from cooking, restroom activities, etc, without running several independent exhaust ducts within the building.

Since only low voltage electrical work is used in embodiments of the present disclosure, the work of an HVAC professional can be completed by running rigid or flexible ducting to the various distribution hubs 102 designed into the building. The ceiling installer can connect the smaller flexible distribution hoses such as hoses 106 and 126 to the appropriate distribution vents as the ceiling is installed, without the need to reschedule the HVAC personnel.

The valve such as valves 116 and 128 which assist in controlling the amount of air passing thru each opening 132 or hose/conduit 106, 126 may be located either in the distribution hub 102, within the vent, or within the hose/conduit. Return air 112 may be connected to vents in the ceiling or in an area near or within the floor to efficiently control airflow based on whether the area is being heated or cooled.

In another embodiment, an area within the distribution hub 102 allows for the connection of other Internet of Things devices to supplement the connectivity of the overall system 100 without the use of additional power on Ethernet POE ports.

While connections to power, such as is provided by low voltage cabling as discussed above, are shown on the distribution hub 102 and secondary fixtures 104, it should be understood that the distribution hoses 106/126 may have an incorporated and flexible cable to pass power and data from endpoint to endpoint without needing to install separate cabling aside from the air ducting hoses 106/128. In embodiments in which a fan is incorporated in the hub 102, an enhanced category cable and connector may be utilized if necessary.

Further, in some embodiments, a building water system, including for example a fire suppression system such as a sprinkler system or the like, or water used for heating or hot water for washing and the like, may also be a part of the system 100. For example, in one embodiment, hot water panels on a roof of a building may be used to heat water for both the heating system and possibly the hot water heater. Since the system 100 addresses the comfort of occupants, zonal heating, cooling and fresh air may be provided by the system 100. By linking pumps within a solar water heating system to the system 100, sensors coupled to solar heated water may determine whether the water is hot enough to generate heat needed by an occupant, allowing heating to be done using the hot water and pumps as opposed to the building furnace. Such heating option may be even more viable on days when occupancy of the building or space is limited to one or a few occupants, as the system 100 allows distribution of heat to where it is needed as opposed to over an entire space or building.

For residential applications, most homes do not circulate hot water in pipes until there is a need for it. When a person in such a home takes a shower, the water is turned on, and a certain amount of water already in the pipes is cleared before hot water appears. This is a common waste of water and energy. In some, typically higher end, homes, a pump may be installed to circulate hot water through the hot water pipes. Such a system can provide near instant hot water. However, such systems also waste energy by running the pump(s) continuously, and distributing hot water throughout the house, causing the hot water heater to run more frequently.

By networking the pump control for the hot water system, the pump would only turn on when someone enters a space. The pump may therefore be a zonal pump rather than a building wide pump which starts up. The trigger for operation of a zonal pump may be any number of potential actions, including but not limited to is the turning on of a light switch in the space, or determination of occupancy by an occupancy sensor that triggers activation of the system.

By being networked in with the system 100, the water system would know when someone is in the house and when the house is vacant. The system may therefore turn down the temperature at which the water heater maintains hot water when the space or building is unoccupied, and turn the hot water heater back on when an occupant is present. For example, if a family vacation is planned, and the water system is properly set up, it may shut off zones that should not need water, to prevent flooding if a pipe bursts or the like. Further, a flow of water through the system, or into specific areas, may be monitored, to determining if unusual usage is occurring.

By being networked in with system 100, the water system could alert a building owner of an unusual increase in the usage of water. Water leaks, or unintentionally running taps or hoses, can cause major damage if they are not caught quickly. Embodiments of the system 100 that include water management as described herein can reduce or prevent these types of damage.

In one embodiment, a water system control manifold includes both cold and hot water controls. In one embodiment, control is through the use of controllable valves which can combine or mix cold water into the hot water channel. Responsible occupants (e.g., adults in a home with children), can select a maximum hot water temperature for a child's bathroom, yet leave the allowable hot water temperature in, for example, a master suite, at a higher temperature. Warm water could also be directed to an outside faucet to provide, for example, warm or hot water for washing a car or the like.

For fire suppression systems connected to the network, a water system embodiment could also, upon activation of the sprinkler system, shut off any non-sprinkler system water usage to direct any and all available water to fire suppression.

The distribution hub 102 includes in one embodiment a circuit board 152 and Ethernet cable plug-in 154 on board the hub 102. The circuit board 152 includes in one embodiment circuits capable of executing the commands provided by the controller 150. The commands may direct the repositioning of various on-board or remote vent dampeners/louvers/valves to allow the system 100 to deliver intended amount of air to the right space. The sensors 130 both incorporated within the hub 102 or remotely situated yet connected directly or wirelessly to the hub 102 or to the controller 150 (such as in secondary fixtures 104 or other locations within the area) may transmit sensor data and information to the controller 150 to allow the controller to analyze the provided information and provide control signals to the various components of the system 100.

In another embodiment, the circuit board 152 includes additional ports to allow connections for the continuation of power and/or data transmission. The additional ports may allow additional connection and communication aside from Ethernet ports, including, by way of example only and not by way of limitation, USB, can-bus, and the like.

Hubs 102 and secondary fixtures 104 may be constructed using metal or plastic, and the hubs 102 and secondary fixtures 104 may be insulated or non-insulated depending on the environment in which they are installed.

Hoses or conduits such as 106, 126, may be connected to the hub 102 or secondary fixtures 104 by a clamping device or a designed snap-fit connector. Other types of connectors will be apparent to those of skill in the art, and are within the scope of the disclosure. For example, a fast connector may incorporate a connection point where the data and power points are accomplished by the connection without having to wire the connection independently.

The computer implemented instructions residing on and/or running on the controller and/or its processor allow for the system 100 to monitor temperatures within the space. The controller 150 may be networked for communication with additional controllers, or to control the functions of additional distribution hubs 102. With a networked controller 150, the controller, and additional controllers that are part of the network, will have information regarding the remainder of the space to be conditioned, up to and including an entire building. With this information, the controller will be able to automate decisions of whether or not to utilize outside fresh air in the area to maintain a constant level of temperature for the space occupant.

Figure 2:
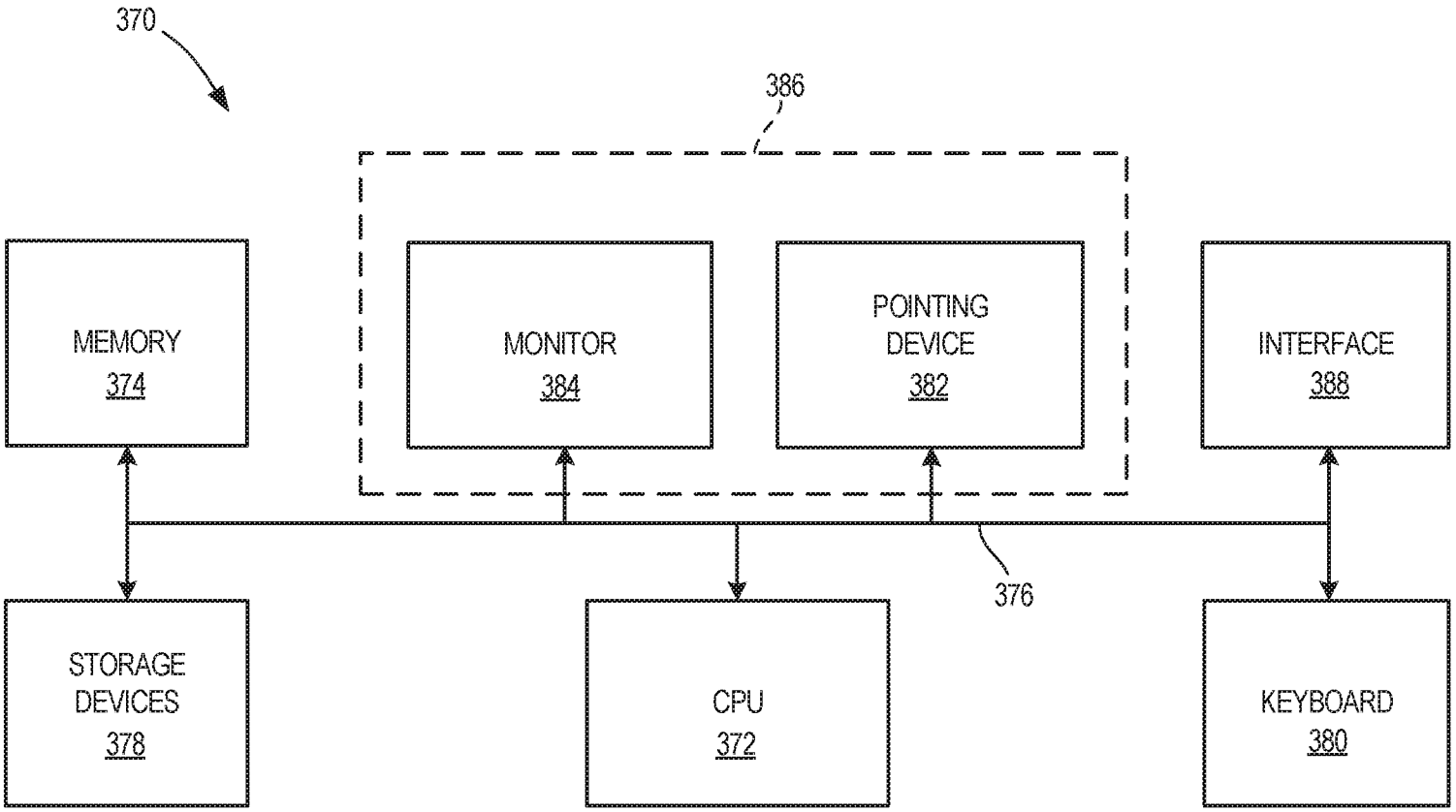
FIG. 2 is a block diagram of a computer on which embodiments of the present disclosure may be practiced.

FIG. 2 shows a representative system that may be connected to and/or used to control embodiments of the present disclosure or a controller, such as controller 100, for those embodiments. The system 200 described herein is usable on all the embodiments herein described, and may comprise a digital and/or analog computer. FIG. 2 and the related discussion provide a brief, general description of a suitable computing environment in which the controller 150 can be implemented. Although not required, the controller 150 can be implemented at least in part, in the general context of computer-executable instructions, such as program modules, being executed by a computer 370 which may be connected in wired or wireless fashion to the controller 150. Generally, program modules include routine programs, objects, components, data structures, etc., which perform particular tasks or implement particular abstract data types. Those skilled in the art can implement the description herein as computer-executable instructions storable on a computer readable medium. Moreover, those skilled in the art will appreciate that the invention may be practiced with other computer system configurations, including multi-processor systems, networked personal computers, mini computers, main frame computers, and the like. Aspects of the invention may also be practiced in distributed computing environments where tasks are performed by remote processing devices that are linked through a communications network. In a distributed computer environment, program modules may be located in both local and remote memory storage devices.

The computer 370 comprises a conventional computer having a central processing unit (CPU) 372, memory 374 and a system bus 376, which couples various system components, including memory 374 to the CPU 372. The system bus 376 may be any of several types of bus structures including a memory bus or a memory controller, a peripheral bus, and a local bus using any of a variety of bus architectures. The memory 374 includes read only memory (ROM) and random access memory (RAM). A basic input/output (BIOS) containing the basic routine that helps to transfer information between elements within the computer 370, such as during start-up, is stored in ROM. Storage devices 378, such as a hard disk, a floppy disk drive, an optical disk drive, etc., are coupled to the system bus 376 and are used for storage of programs and data. It should be appreciated by those skilled in the art that other types of computer readable media that are accessible by a computer, such as magnetic cassettes, flash memory cards, digital video disks, random access memories, read only memories, and the like, may also be used as storage devices. Commonly, programs are loaded into memory 374 from at least one of the storage devices 378 with or without accompanying data.

Input devices such as a keyboard 380 and/or pointing device (e.g. mouse, joystick(s)) 382, or the like, allow the user to provide commands to the computer 370. A monitor 384 or other type of output device can be further connected to the system bus 376 via a suitable interface and can provide feedback to the user. If the monitor 384 is a touch screen, the pointing device 382 can be incorporated therewith. The monitor 384 and input pointing device 382 such as mouse together with corresponding software drivers can form a graphical user interface (GUI) 386 for computer 370. Interfaces 388 on the system controller 300 allow communication to other computer systems if necessary. Interfaces 388 also represent circuitry used to send signals to or receive signals from the actuators and/or sensing devices mentioned above. Commonly, such circuitry comprises digital-to-analog (D/A) and analog-to-digital (A/D) converters as is well known in the art.

Although the present disclosure has been described with reference to preferred embodiments, workers skilled in the art will recognize that changes may be made in form and detail without departing from the spirit and scope of the disclosure.

What is claimed is:

1. A system for control of conditioned air within a space, comprising:

a distribution hub connected to provide external conditioned air from outside of the system and outside of the space, fresh air, or a combination thereof to the space, and to exhaust and/or return air from the space through the distribution hub;

a controller coupled to the distribution hub to control the provision of the external conditioned air and the fresh air, and to control removal of the return air; and a secondary fixture coupled to the distribution hub, the controller configured to provide bidirectional air flow to and from the secondary fixture from and to the distribution hub, wherein air flow to the secondary fixture is provided through a first distribution conduit, and air flow from the secondary fixture is provided through a second, separate distribution conduit.

2. The system of claim 1, wherein the distribution hub further comprises:

a plurality of sensors in flow paths for the conditioned air, the fresh air, the return air, and the exhaust air, the plurality of sensors coupled to the controller to provide sensor information thereto; and a plurality of valves, the plurality of valves operable by the controller to adjust air flow in the flow paths to provide adjusted air flow to the space.

3. The system of claim 1, wherein the secondary fixture includes lights and distribution vents for air.

4. The system of claim 3, wherein each secondary fixture has a return air path to the distribution hub.

5. The system of claim 3, wherein each secondary fixture has at least one valve operable by the controller to adjust air flow therein.

6. The system of claim 5, wherein each secondary fixture has a first valve operable to adjust air flow from the distribution hub, and a second valve operable to adjust air flow to the distribution hub.

7. The system of claim 3, wherein each secondary fixture is coupled to conditioned air and fresh air ports in the distribution hub, and wherein each secondary fixture is coupled to return air and exhaust air ports in the distribution hub, and wherein the controller is configured to operate each secondary fixture as a bidirectional air flow fixture depending on a desired configuration of the space.

8. The system of claim 3, and further comprising:

a low voltage power source to operate the controller, the distribution hub, and the plurality of secondary fixtures.

9. The system of claim 3, wherein at least one of the plurality of secondary fixtures includes a lighting system controllable by the controller.

10. A combined system for control of conditioned air and lighting within a space, comprising:

a controller;

a distribution box having a circuit board coupled to the controller and configured to execute commands provided by the controller, the distribution box having a port coupleable to a source of conditioned air that is conditioned outside of the system and of the space to selectively provide external conditioned air through the port, the distribution box comprising at least one duct and at least one secondary fixture port;

a service node comprising a light system and an air flow system, the service node coupled to the source of conditioned air through the at least one duct, and coupled to the controller to receive power and data, wherein the controller is configured to control bidirectional air flow and return flow to and from the service node, wherein air flow to the service node provided through a first distribution conduit, and air flow from the service node is provided through a second, separate distribution conduit.

11. The system of claim 10, wherein the controller comprises:

a low voltage power supply;

a data and power connection from the controller to the circuit board, the data and power connection coupling data and power to the circuit board.

12. A method of controlling conditioning of air in a space, comprising:

providing a distribution hub having an air supply conduit coupleable to a source of conditioned air that is external to the system and to the space, a source of fresh air, or a combination thereof, and having an exhaust conduit separate from the air supply conduit and coupleable to exhaust and/or return air from the space through the distribution hub to a plurality of secondary fixtures, each secondary fixture coupled to the distribution hub and configured to provide bidirectional air flow to or from the secondary fixture to the space, wherein air flow is provided to the secondary fixture with a first distribution conduit, and air flow is provided from the secondary fixture with a second separate distribution conduit;

controlling a supply of air to the space through the air supply conduit, the secondary fixture, and the first distribution conduit;

controlling an exhaust of air from the space through the secondary fixture, the second distribution conduit, and the exhaust conduit;

wherein controlling the supply of air and the exhaust of air is performed by a controller coupled to the distribution hub.

13. The method of claim 12, wherein controlling a supply of air comprises:

controlling a plurality of valves, the plurality of valves operable by the controller to adjust air flow in the flow paths to provide properly adjusted air flow to the space; and monitoring a plurality of sensors in flow paths for the conditioned air, the fresh air, the return air, and the exhaust air, the plurality of sensors coupled to the controller to provide sensor information thereto.

14. The method of claim 12, and further comprising controlling at least one valve in each of the plurality of secondary fixtures to adjust air flow in its individual flow path.

15. The system of claim 14, wherein controlling at least one valve comprises adjusting a first valve operable to adjust air flow from the distribution hub, and adjusting a second valve operable to adjust air flow to the distribution hub.

16. The method of claim 12, and further comprising controlling lighting functions via the controller.

17. The method of claim 12, and further comprising controlling conditioned air functions via the controller.

* * * * *